US006463409B1

(12) United States Patent
Ihara

(10) Patent No.: US 6,463,409 B1
(45) Date of Patent: Oct. 8, 2002

(54) METHOD OF AND APPARATUS FOR DESIGNING CODE BOOK OF LINEAR PREDICTIVE PARAMETERS, METHOD OF AND APPARATUS FOR CODING LINEAR PREDICTIVE PARAMETERS, AND PROGRAM STORAGE DEVICE READABLE BY THE DESIGNING APPARATUS

(75) Inventor: Takeki Ihara, Tsurugashima (JP)

(73) Assignee: Pioneer Electronic Corporation, Tokyo-to (JP)

( * ) Notice: Subject to any disclaimer, the term of this patent is extended or adjusted under 35 U.S.C. 154(b) by 0 days.

(21) Appl. No.: 09/253,722

(22) Filed: Feb. 22, 1999

(30) Foreign Application Priority Data

Feb. 23, 1998 (JP) ..... 10-040509

(51) Int. Cl.[7] ..... G10L 19/04

(52) U.S. Cl. ..... 704/219; 704/220; 704/230; 704/207; 704/222

(58) Field of Search ..... 704/219, 220, 704/221, 222, 230, 231, 232, 223, 207

(56) References Cited

U.S. PATENT DOCUMENTS 5,327,520 A * 7/1994 Chen ..... 704/219
5,384,891 A * 1/1995 Asakawa et al. ..... 704/220
5,485,581 A * 1/1996 Miyano et al. ..... 704/223
5,651,090 A * 7/1997 Moriya et al. ..... 704/222
5,659,659 A * 8/1997 Kolesnik et al. ..... 704/219
5,742,733 A * 4/1998 Jarvinen ..... 704/220
5,745,871 A * 4/1998 Chen ..... 704/207
5,890,110 A * 3/1999 Gersho et al. ..... 704/222
6,018,707 A * 1/2000 Nishiguchi et al. ..... 704/222
RE36,646 E * 4/2000 Akamine et al. ..... 704/223

OTHER PUBLICATIONS

Gersho et al., ("Linear Prediction", Chapter 4, Vector Quantization and Signal Compression, Kluwer Academic Publishers, 1992, pp. 83–129).*

* cited by examiner

*Primary Examiner*—Vijay B Chawan
(74) *Attorney, Agent, or Firm*—Finnegan, Henderson, Farabow, Garrett & Dunner, L.L.P.

(57) ABSTRACT

A code book is a set of code vectors to be selected when linear predictive parameters are vector-quantized as for an input audio which is divided into frames, each of which is further divided into sub frames. A code book designing method is provided with: a calculating processes of calculating the linear predictive parameters of the input audio for the sub frames respectively; a quantizing process of calculating a plurality of quantization candidates which are candidates for the code vectors with respect to the linear predictive parameters of the input audio as for the sub frames positioned at a predetermined interval set in advance; an interpolating process of calculating interpolation values for the linear predictive parameters on the basis of the calculated quantization candidates as for the sub frames other than the sub frames positioned at the predetermined interval; and a determining process of determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

12 Claims, 3 Drawing Sheets

METHOD OF AND APPARATUS FOR DESIGNING CODE BOOK OF LINEAR PREDICTIVE PARAMETERS, METHOD OF AND APPARATUS FOR CODING LINEAR PREDICTIVE PARAMETERS, AND PROGRAM STORAGE DEVICE READABLE BY THE DESIGNING APPARATUS

BACKGROUND OF THE INVENTION

1. Field of the Invention

The present invention relates to a method of and an apparatus for designing a code book of linear predictive parameters, and also a method of and an apparatus for coding linear predictive parameters by use of the designed code book, which are used for the vector quantization of the linear predictive parameters for an audio signal (such as a voice signal, a music signal or the like). The present invention further relates to a program storage device readable by such a code book designing apparatus.

2. Description of the Related Art

There is a high efficiency coding method using a vector quantization of integrating an audio signal for each of a plurality of parameters and quantizing each integrated audio signal. A linear predictive parameter is one of important transmission parameters to be coded. In case of vector-quantizing this linear predictive parameter, a code book (i.e., a set of code vectors) is often used, which stores in advance the representative linear predictive parameters in the interval of each sub frame, into which the audio signal divided by each frame is further divided. Then, upon coding the linear predictive parameters, the vector quantization is performed by selecting a linear predictive parameter, whose similarity is the highest among the code book, as the code vector.

By the way, when this type of code book is designed, a training procedure by means of a repeat calculating method is performed with respect to a learning data base, which includes linear predictive parameters supposed to be obtained from an input signal, so that an appropriate code vector is determined respectively. Here, in the actual coding process, the vector quantization of the linear predictive parameters is performed at a predetermined interval of sub frames, because of a restriction of the data amount and the calculation amount. Then, with respect to the sub frames positioned between the sub frames to which the vector quantization is performed (i.e., as for the sub frames to which the vector quantization is not performed), the linear predictive parameters are linear-interpolated. Therefore, in order to match with this way of the vector quantization and the linear interpolation, in the above mentioned training procedure, the optimum code vector is determined so as to minimize the distortion due to the quantization of the linear predictive parameters in accordance with the predetermined interval of sub frames, and then the code book based on the determined code vectors is designed.

However, when designing the code book, if the vector-quantization of the linear predictive parameters is to be performed only at the predetermined interval of sub frames in the above mentioned manner, although it is possible to select the appropriate code vector whose distortion of the quantization is little, the selected code vector is not always the optimum one with considering the existence of the other sub frames positioning between the sub frames to which the vector quantization is performed. Namely, there may be a case that the interpolation value of the linear predictive parameter is not coincident with the value of the genuine linear predictive parameter of the sub frame, resulting in that the distortion becomes large. In such a case, even if the training procedure is conducted by means of the aforementioned repeat calculating method, it is difficult to design the code book which is optimized for all of the sub frames.

On the other hand, in order to solve this problem, it may be tried to perform an evaluation for the quantization distortion as for all of the sub frames, whether or not the vector quantization is to be performed to the sub frames, between the immediate sub frame whose code vector has been just determined and the sub frame whose code vector is to be newly determined, and to use the evaluation result for the evaluation of the quantization distortion of the subsequent sub frame. However, if such a process is performed, although it is possible to perform the vector quantization for a specific sub frame, which reflects the interpolation of its timely preceding sub frame, it is not possible to perform the vector quantization for this specific sub frame, which reflect the interpolation of its timely subsequent sub frame at the moment, resulting in that it is not enough to select the optimum code vector.

SUMMARY OF THE INVENTION

It is therefore an object of the present invention to provide: a method of and apparatus for designing a highly efficient code book as a set of code vectors, which can perform a vector quantization of linear predictive parameters by selecting optimum code vectors capable of diminishing distortions of all sub frames which include the sub frames for which the interpolation value of the linear predictive parameters are calculated; a method of and an apparatus for coding the linear predictive parameters highly efficiently by use of the designed code book; and a program storage device readable by the code book designing apparatus.

The above object of the present invention can be achieved by a code book designing method of designing a code book which is a set of code vectors to be selected when linear predictive parameters are vector-quantized as for an input audio which is divided into frames, each of which is further divided into sub frames. The code book designing method is provided with: a calculating processes of calculating the linear predictive parameters of the input audio for the sub frames respectively; a quantizing process of calculating a plurality of quantization candidates which are candidates for the code vectors with respect to the linear predictive parameters of the input audio as for the sub frames positioned at a predetermined interval set in advance; an interpolating process of calculating interpolation values for the linear predictive parameters on the basis of the calculated quantization candidates as for the sub frames other than the sub frames positioned at the predetermined interval; and a determining process of determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

According to the code book designing method of the present invention, when the input audio (e.g., data from a learning data base as an audio signal) is inputted, the linear predictive parameters of the input audio is calculated for the sub frames respectively. Then, as for the sub frames positioned at the predetermined interval, a plurality of quantization candidates which are candidates for the code vectors with respect to the linear predictive parameters of the input audio are calculated. On the other hand, as for the sub frames other than the sub frames positioned at the predetermined interval, the interpolation values for the linear predictive parameters are calculated on the basis of the calculated quantization candidates. Then, the code vectors are selected from among the calculated quantization candidates, on the basis of the calculated quantization candidates, the calculated interpolation values and the calculated linear predictive parameters, within the range of continuous sub frames in the predetermined number, so that the code vectors of the code book are determined.

Accordingly, when designing the code book corresponding to the method of coding the linear predictive parameters at the predetermined interval of sub frames, the code vectors can be selected while not only the sub frames which are the objects for the quantizing process are optimized but also the sub frames which are the objects for the interpolating process are optimized, and that they are optimized regardless of the forward or backward in time, a highly efficient code book can be designed without a drastic increase of the calculation amount.

In one aspect of the code book designing method of the present invention, the determining process is provided with: a process of calculating distortions of the calculated quantization candidates and the calculated interpolation values with respect to the calculated linear predictive parameters for the sub frames respectively; and a process of determining the code vectors so as to minimize an average of the calculated distortions.

According to this aspect, in the determining process, the distortions of the calculated quantization candidates and the calculated interpolation values with respect to the calculated linear predictive parameters are calculated for the sub frames respectively. Then, the code vectors are determined so as to minimize the average of the calculated distortions.

Accordingly, the code vectors can be selected so that the distortions can be made small for the sub frames which are the objects for the quantization and for the sub frames which are the objects for the interpolation. Thus, it is possible to design the code book capable of coding the linear predictive parameters with a high fidelity to the input audio and with a high audio quality.

The above object of the present invention can be also achieved by a code book designing apparatus for designing a code book which is a set of code vectors to be selected when linear predictive parameters are vector-quantized as for an input audio which is divided into frames, each of which is further divided into sub frames. The code book designing apparatus is provided with: a calculating device for calculating the linear predictive parameters of the input audio for the sub frames respectively; a quantizing device for calculating a plurality of quantization candidates which are candidates for the code vectors with respect to the linear predictive parameters of the input audio as for the sub frames positioned at a predetermined interval set in advance; an interpolating device for calculating interpolation values for the linear predictive parameters on the basis of the calculated quantization candidates as for the sub frames other than the sub frames positioned at the predetermined interval; and a determining device for determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

According to the code book designing apparatus of the present invention, in the same manner as the above described code book designing method of the present invention, when designing the code book corresponding to the method of coding the linear predictive parameters at the predetermined interval of sub frames, the code vectors can be selected while not only the sub frames which are the objects for the quantizing process are optimized but also the sub frames which are the objects for the interpolating process are optimized, and that they are optimized regardless of the forward or backward in time, a highly efficient code book can be designed without a drastic increase of the calculation amount.

In one aspect of the code book designing apparatus of the present invention, the determining device is provided with: a device for calculating distortions of the calculated quantization candidates and the calculated interpolation values with respect to the calculated linear predictive parameters for the sub frames respectively; and a device for determining the code vectors so as to minimize an average of the calculated distortions.

According to this one aspect of the code book designing apparatus of the present invention, in the same manner as the above described one aspect of the code book designing method of the present invention, the code vectors can be selected so that the distortions can be made small for the sub frames which are the objects for the quantization and for the sub frames which are the objects for the interpolation. Thus, it is possible to design the code book capable of coding the linear predictive parameters with a high fidelity to the input audio and with a high audio quality.

The above object of the present invention can be also achieved by a coding method of coding linear predictive parameters, by use of a code book which is a set of code vectors to be selected when the linear predictive parameters are vector-quantized as for an input audio which is divided into frames, each of which is further divided into sub frames. The coding method is provided with: a calculating processes of calculating the linear predictive parameters of the input audio for the sub frames respectively; a quantizing process of calculating a plurality of quantization candidates which are candidates for the code vectors with respect to the linear predictive parameters of the input audio as for the sub frames positioned at a predetermined interval set in advance; an interpolating process of calculating interpolation values for the linear predictive parameters on the basis of the calculated quantization candidates as for the sub frames other than the sub frames positioned at the predetermined interval; and a selecting process of selecting the code vectors from among the calculated quantization candidates on the basis of the calculated quantization candidates, the calculated interpolation values and the calculated linear predictive parameters, within a range of continuous sub frames in a predetermined number set in advance, and outputting the selected code vectors.

According to the coding method of the present invention, when the input audio (e.g., an actually sampled signal as an audio signal) is inputted, the linear predictive parameters of the input audio is calculated for the sub frames respectively. Then, as for the sub frames positioned at the predetermined interval, a plurality of quantization candidates which are candidates for the code vectors with respect to the linear predictive parameters of the input audio are calculated. On the other hand, as for the sub frames other than the sub frames positioned at the predetermined interval, the interpolation values for the linear predictive parameters are calculated on the basis of the calculated quantization candidates. Then, the code vectors are selected from among the calculated quantization candidates, on the basis of the calculated quantization candidates, the calculated interpolation values and the calculated linear predictive parameters, within the range of continuous sub frames in the predetermined number, so that the selected code vectors are outputted.

Accordingly, when coding the linear predictive parameters at the predetermined interval of sub frames, the code vectors can be selected while not only the sub frames which are the objects for the quantizing process are optimized but also the sub frames which are the objects for the interpolating process are optimized, and that they are optimized regardless of the forward or backward in time, it becomes possible to perform a highly efficient coding process without a drastic increase of the calculation amount by use of the code book.

In one aspect of the coding method of the present invention, the coding method is further provided with an updating process of updating the code vectors of the code book by the selected code vectors.

According to this aspect, when the code vectors are selected, the code vectors of the code book are updated by the selected code vectors. Thus, the content of the code book for the linear predictive parameters can be upgraded in its quality along with the coding process, so that the coding process for the linear predictive parameters can be optimized automatically along with the coding process by use of the code book.

In another aspect of the coding method of the present invention, the selecting process is provided with: a process of calculating distortions of the calculated quantization candidates and the calculated interpolation values with respect to the calculated linear predictive parameters for the sub frames respectively; and a process of selecting the code vectors so as to minimize an average of the calculated distortions.

According to this aspect, in the selecting process, the distortions of the calculated quantization candidates and the calculated interpolation values with respect to the calculated linear predictive parameters are calculated for the sub frames respectively. Then, the code vectors are selected so as to minimize the average of the calculated distortions.

Accordingly, the code vectors can be selected so that the distortions can be made small for the sub frames which are the objects for the quantization and for the sub frames which are the objects for the interpolation. Thus, it becomes possible to perform a highly efficient coding process without a drastic increase of the calculation amount by use of the code book.

The above object of the present invention can be also achieved by a coding apparatus for coding linear predictive parameters, by use of a code book which is a set of code vectors to be selected when the linear predictive parameters are vector-quantized as for an input audio which is divided into frames, each of which is further divided into sub frames. The coding apparatus is provided with: a calculating device for calculating the linear predictive parameters of the input audio for the sub frames respectively; a quantizing device for calculating a plurality of quantization candidates which are candidates for the code vectors with respect to the linear predictive parameters of the input audio as for the sub frames positioned at a predetermined interval set in advance; an interpolating device for calculating interpolation values for the linear predictive parameters on the basis of the calculated quantization candidates as for the sub frames other than the sub frames positioned at the predetermined interval; and a selecting device for selecting the code vectors from among the calculated quantization candidates on the basis of the calculated quantization candidates, the calculated interpolation values and the calculated linear predictive parameters, within a range of continuous sub frames in a predetermined number set in advance, and outputting the selected code vectors.

According to the coding apparatus of the present invention, in the same manner as the above described coding method of the present invention, when coding the linear predictive parameters at the predetermined interval of sub frames, the code vectors can be selected while not only the sub frames which are the objects for the quantizing process are optimized but also the sub frames which are the objects for the interpolating process are optimized, and that they are optimized regardless of the forward or backward in time, it becomes possible to perform a highly efficient coding process without a drastic increase of the calculation amount by use of the code book.

In one aspect of the coding apparatus of the present invention, the coding apparatus is further provided with an updating device for updating the code vectors of the code book by the selected code vectors.

According to this one aspect of the coding apparatus of the present invention, in the same manner as the above described one aspect of the coding method of the present invention, the content of the code book for the linear predictive parameters can be upgraded in its quality along with the coding process, so that the coding process for the linear predictive parameters can be optimized automatically along with the coding process by use of the code book.

In another aspect of the coding apparatus of the present invention, the selecting device is provided with: a device for calculating distortions of the calculated quantization candidates and the calculated interpolation values with respect to the calculated linear predictive parameters for the sub frames respectively; and a device for selecting the code vectors so as to minimize an average of the calculated distortions.

According to this another aspect of the coding apparatus of the present invention, in the same manner as the above described another aspect of the coding method of the present invention, it becomes possible to perform a highly efficient coding process without a drastic increase of the calculation amount by use of the code book.

The above object of the present invention can be also achieved by a program storage device readable by a computer for designing a code book, tangibly embodying a program of instructions executable by the computer to perform method processes for designing the code book which is a set of code vectors to be selected when linear predictive parameters are vector-quantized as for an input audio which is divided into frames, each of which is further divided into sub frames. The method processes include: calculating the linear predictive parameters of the input audio for the sub frames respectively; calculating a plurality of quantization candidates which are candidates for the code vectors with respect to the linear predictive parameters of the input audio as for the sub frames positioned at a predetermined interval set in advance; calculating interpolation values for the linear predictive parameters on the basis of the calculated quantization candidates as for the sub frames other than the sub frames positioned at the predetermined interval; and determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

Accordingly, the above described code book designing method of the present invention can be performed as the program stored in the program storage device is installed to the computer for designing the code book and the computer executes the installed program.

In one aspect of the program storage device of the present invention, the determining process is provided with: calculating distortions of the calculated quantization candidates and the calculated interpolation values with respect to the calculated linear predictive parameters for the sub frames respectively; and determining the code vectors so as to minimize an average of the calculated distortions.

Accordingly, the above described one aspect of the code book designing method of the present invention can be performed as the program stored in this one aspect of the program storage device is installed to the computer for designing the code book and the computer executes the installed program.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiments of the present invention will be now explained.

Figure 1:
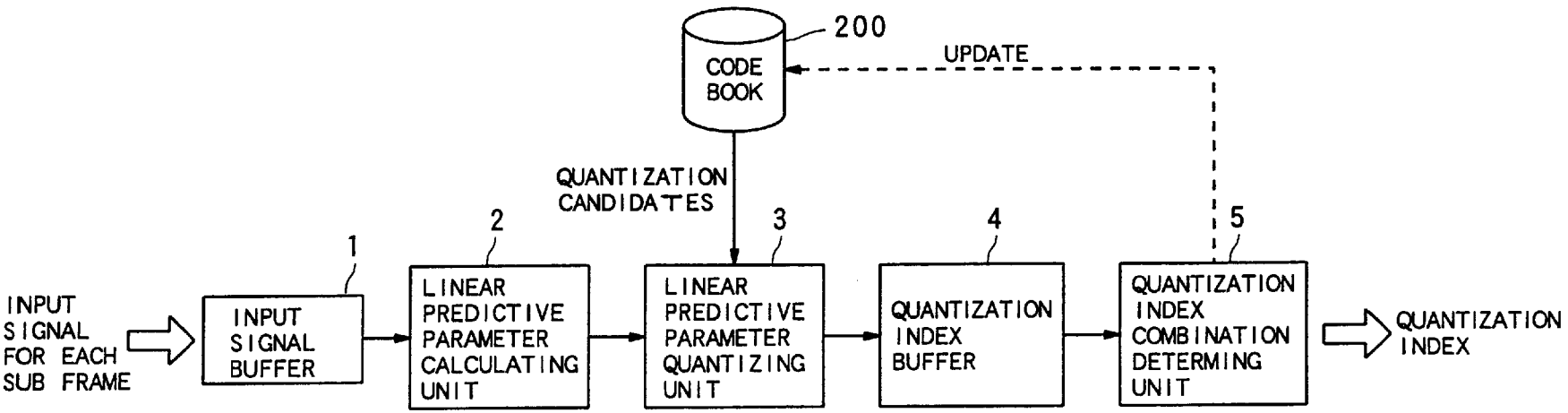
FIG. 1 is a block diagram showing a whole structure of an apparatus for coding linear predictive parameters as an embodiment of the present invention.

In FIG. 1, an apparatus for coding linear predictive parameters as one embodiment of the present invention is provided with an input signal buffer 1, a linear predictive parameter calculating unit 2, a linear predictive parameter quantizing unit 3, a quantization index buffer 4 and a quantization index combination determining unit 5.

An analog input audio (e.g., a voice, a music sound or the like) is sampled, is converted to a digital value and is divided into frames for each of the sampled values. Each of the frames is further divided into a plurality of sub frames, and are inputted into the input signal buffer 1, by the unit of sub frame. Each of the sub frames includes a predetermined number of the sampled values with respect to the input audio.

The linear predictive parameter calculating unit 2 calculates a predictive parameter for each of the sub frames.

The linear predictive parameter quantizing unit 3 vector-quantizes the linear predictive parameters obtained by the linear predictive parameter calculating unit 2 on the basis of a code book 200 in accordance with the process described later, for each of the intervals of predetermined sub frames which are set in advance. At this time, a plurality of quantization parameters suitable for the vector quantization are preliminarily selected as candidates for the quantization from the code book 200.

The quantization index buffer 4 temporarily holds the indexes of the code vectors, which have been preliminarily selected by the linear predictive parameters, from the code vectors constituting the code book 200.

The quantization index combination determining unit 5 determines the combination of the quantization parameters which minimize the quantization distortion from among the combinations of the quantization candidates which have been preliminarily selected, within the range of the continuous sub frames in the predetermined number set in advance. At this time of evaluating the distortion, as for the sub frames other than the sub frames which are positioned at the predetermined interval (i.e., other than the sub frames to which the vector quantization is performed), the distortion based on the interpolation value due to the quantizing parameters are considered. The detail of these processes will be described later in detail.

Figure 2A:
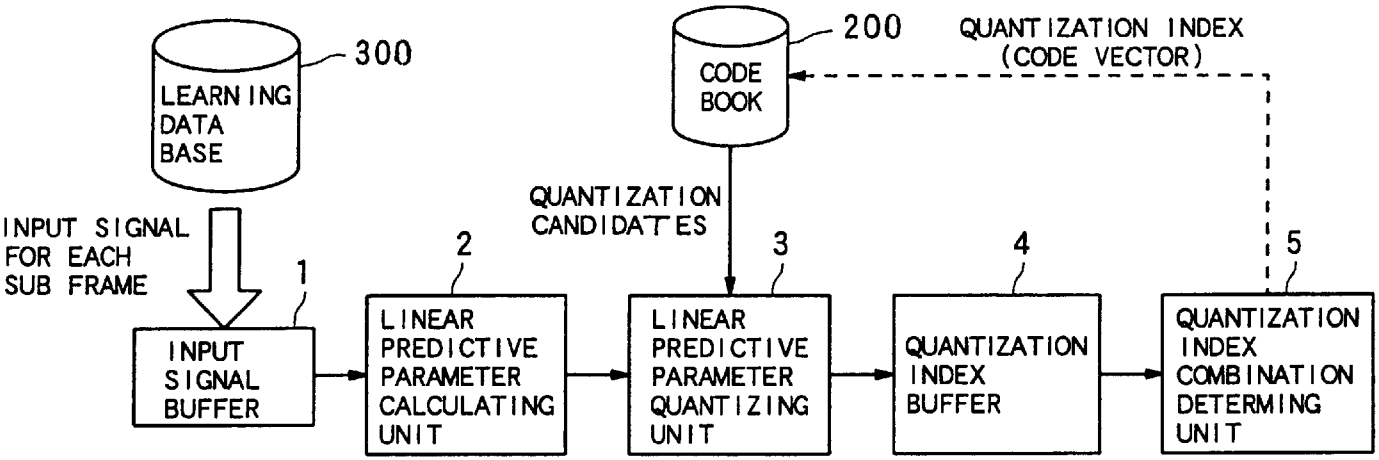
FIG. 2A is a block diagram showing a whole structure of an apparatus for designing a code book as another embodiment of the present invention.

In FIG. 2A, an apparatus for designing the code book as another embodiment of the present invention is provided with the input signal buffer 1, the linear predictive parameter calculating unit 2, the linear predictive parameter quantizing unit 3, the quantization index buffer 4 and the quantization index combination determining unit 5. In FIG. 2A, the same constitutional elements as those in FIG. 1 carry the same reference numerals and the explanations thereof are omitted.

The apparatus for designing the code book shown in FIG. 2A has a same construction as the above described apparatus for coding the linear predictive parameters shown in FIG. 1, except that it uses a learning data base 300 as the input signal through the input signal buffer 1, and that the content of the code book 200 is determined by the quantization index combination determining unit 5 in the training procedure by means of the repeat calculating method, so that the code book can be designed to be highly efficient one.

Figure 2B:
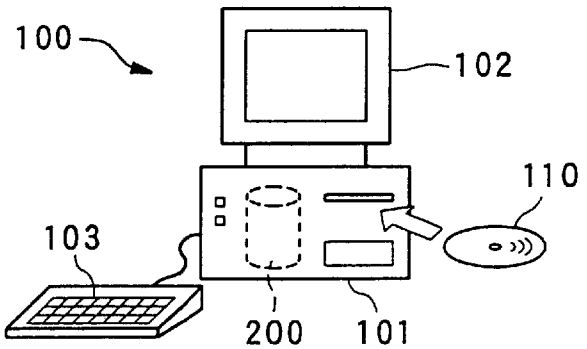
FIG. 2B is an appearance view of a computer system in which an apparatus for designing the code book of FIG. 2A is constructed.

FIG. 2B shows an appearance of the apparatus for designing the code book of FIG. 2A.

In FIG. 2B, the apparatus for designing the code book is realized by a computer system 100 provided with: a main unit 101 including a CPU (Central Processing Unit), a RAM (Random Access Memory) storing the code book 200, a reading device etc.,; a displaying unit 102 for displaying various information; and an inputting device 103 for inputting various command, data and so on. A record medium 110 such as a CD-ROM, a DVD-ROM, a floppy disc or the like, is loaded to the main unit 101 as one example of a program storage device readable by the computer system 100, so that the computer system 100 functions in accordance with the program stored in the record medium 110 as the apparatus for designing the code book.

Incidentally, the apparatus for coding the linear predictive parameters shown in FIG. 1 may be realized by a computer system as shown in FIG. 2B, or may be realized by a micro computer equipped in a portable telephone, a portable electronic equipment, a note book computer or any kind of electronic equipment in which the coding process for the audio signal is performed.

Figure 3:
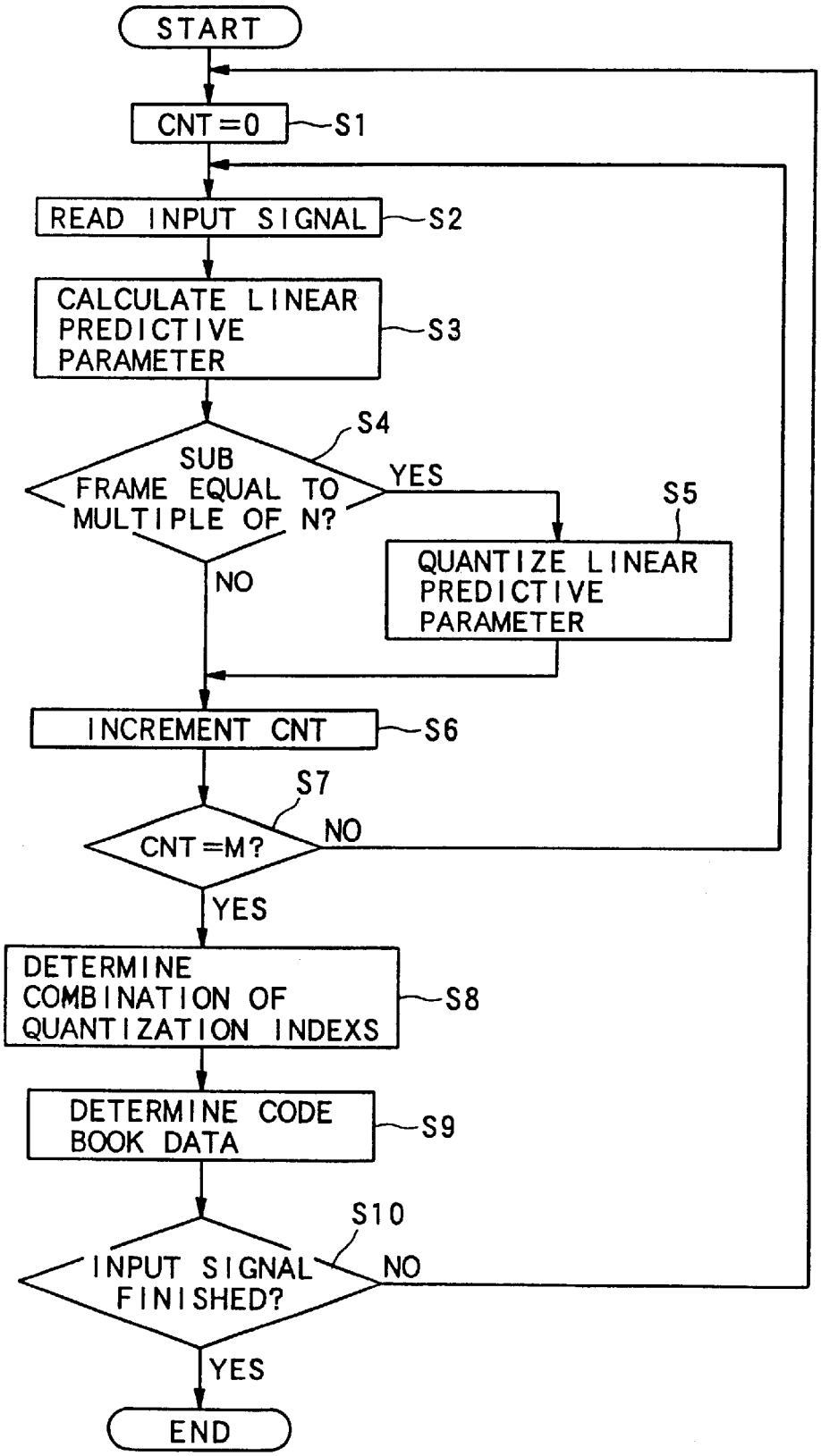
FIG. 3 is a flow chart showing a code book designing operation for the vector quantization of the linear predictive parameters in the embodiment.

FIG. 3 shows a code book designing operation for the vector-quantization of linear predictive parameters in the apparatus for designing the code book shown in FIG. 2A. In FIG. 3, it is assumed that the predetermined interval of sub frames in the linear predictive parameter quantizing unit 3 is N (sub frames), the number of the quantization candidates preliminarily selected by the linear predictive parameter quantizing unit 3 is H (candidates), and the predetermined number of the continuous sub frames in the quantization index combination determining unit 5 is M (sub frames). This number M may correspond to a range within one frame or a plurality of frames. The frame is divided into the sub frames, which are the basic units for the process in the present embodiment.

In FIG. 3, at first, a counter value CNT for counting the sub frames sequentially in the range of the M sub frames is zero-cleared (step S1).

Then, the sampled value of the input signal is read into the linear predictive parameter calculating unit 2 through the input signal buffer 1 for each sub frame (step S2). Here, in the code book designing process, data in the learning data base 300 is used as this input signal through the input signal buffer 1. In this learning data base 300, various data corresponding to various audio signals assumed to be the actual input signals are included. Thus, the learning data base 300 is suitable to train the code book 200.

Then, a calculation for the linear predictive parameter as for each of the sub frames is performed (step S3). As a representative of the linear predictive parameters, there are the PARCOR (Partial Auto-CORrelation) coefficient, the LSP (Line Spectrum Pair) and so on. Especially, since the LSP is superior in the interpolation characteristic, it is suitable for the present embodiment in which the interpolation is premised. Incidentally, the linear predictive parameters obtained by the step S3 becomes an object for the quantization of each interval N of sub frames, and also becomes necessary for the evaluation of the quantization distortion including the sub frames which are not quantized (but are interpolated).

Then, it is judged whether or not the current sub frame is the sub frame, to which the quantizing process for the linear predictive parameter for each interval N of the sub frames is to be applied. Namely, it is judged whether or not the current sub frame is equal to the multiple of N frames (step S4). As a result of the judgment, if the quantizing process is necessary since it is the sub frame positioned at the interval N of sub frames (step S4: YES), the quantizing process for the linear predictive parameters is performed by selecting a plurality of quantization candidates (step S5). Then, the operation flow proceeds to a step S6. On the other hand, if the quantizing process is not necessary since it is not the sub frame positioned at the interval N of sub frames (step S4: NO), the operation flow directly proceeds to the step S6.

In the quantizing process for the linear predictive parameters at the step S5, the preliminary selection is introduced. Namely, in advance of determining the optimum code vectors in the quantization index combination determining unit 5, the code vectors in the predetermined number are selected beforehand as the quantization candidates from the code book 200. The selection of the quantization candidates may be performed by a method of selecting them in the order of minimizing the square of an weighted Euclid distance for example. As mentioned before, the number of the preliminary selected code vectors is H (candidates), and it is possible to determine the quantization candidates by the indexes given to the code vectors preliminarily selected in the code book 200. Therefore, it is necessary to constitute the code book 200 so as to include a large number of code vectors which can be preliminarily selected from the initial condition.

In the step S6, the count CNT is incremented so as to advance the process to the sub frame which is positioned next to the current sub frame.

Next, it is judged whether or not the process is completed for the continuous M sub frames according to the count CNT. Namely, it is judged whether or not the count CNT has reached M (step S7). As a result of the judgment, if the count CNT has never reached M (step S7: NO), since there remains a sub frame or frames to be processed, the operation flow returns to the step S2. On the other hand, if the count CNT has already reached M (step S7: YES), the operation flow proceeds to a step S8.

In the step S8, the process of determining the optimum combination of the quantization indexes within the range of the M continuous sub frames is performed (step S8). Here, if each numerical value is set so as to satisfy the relationship expressed by a following expression (1), a sub frames, to which the preliminary selection is to be performed, are included in M sub frames.

$$M=a\times N \tag{1}$$

Therefore, since there exist H quantization candidates respectively, there exist H×a combinations of the quantization candidates, which are possible within the range of M sub frames. In the step S8, from among these all combinations, the optimum combination is determined. Incidentally, upon setting each numerical value, since an enormous calculation amount would be necessary if setting the value a or H to a large value, so that it is preferable to set them in the actual range.

In the optimum combination determining process, the evaluation for the quantization distortion is performed. From among H×a combinations of the quantization candidates, the quantization distortions with respect to all of M sub frames are calculated, the combination which minimizes the average of the quantization distortions is searched, and the training of the code book 200 is performed on the basis of the indexes of the code vectors included in the searched combination.

Here, as for the remaining sub frames other than a sub frames to which the preliminary selections for the quantization candidates are performed, the linear interpolation values are obtained respectively by use of the code vectors corresponding to the quantization candidates. More concretely, assuming that the specific quantization candidates in the sub frame to which the quantization is to be currently performed and the sub frame to which the quantization is nextly performed are represented by vectors Y and Y' respectively, the interpolation by use of the vector Q calculated by a following expression (2) is performed as for the sub frame positioned at the $n^{th}$ position from the sub frame corresponding to the vector Y.

$$Q=\{(N-n)\times Y+n\times Y\}/n \tag{2}$$

Then the weighted error of the respective linear predictive parameter is calculated respectively on the basis of the quantization candidates or the linear interpolation values, with respect to M continuous sub frames. After that, the combination of the quantization candidates, which minimizes the average value of the M sub frames, is finally obtained.

When the combination is determined in this manner, the code vectors of the corresponding indexes become the data for designing the code book 200 which is the design object (step S9).

Next, it is judged whether there exists any input signal to be processed or the input signal is finished (step S10). If there exists the input signal (step S10: NO), the operation flow returns to the step S1. When the input signal is finished (step S10: YES), the data content of the code book 200 is determined, so that the process of designing the code book 200 is ended.

Incidentally, in case of applying the present invention to the apparatus for coding the linear predictive parameters shown in FIG. 1, when the step S8 is finished, the apparatus outputs the quantization indexes, which have been finally obtained, as the coded data of the linear predictive parameters. At this time, it is possible to update the data content of the code book 200 equipped in the apparatus for coding the linear predictive parameters on the basis of the obtained quantization indexes. Alternatively, it is possible not to update the data content of the code book 200 equipped in the apparatus for coding the linear predictive parameters. After that, the operation flow proceeds to the step S10, and it is judged whether the process for the next input signal is continued or the coding process is to be ended.

According to the code book designing method of the present invention, the data in the code book 200 can be designed or determined on the basis of the above explained processes. At this time, in addition to the sub frames with respect to which the linear predictive parameters are quantized at the interval N of sub frames, the sub frames with respect to which the linear interpolation is performed become the objects for the distortion evaluation due to the quantization. Thus, it is possible to determine the data content of the code book 200 with considering the influence of the linear interpolation. Further, this distortion evaluation is performed with respect to the M continuous sub frames such that the optimum combination is determined from among the H quantization candidates preliminarily selected as for each of the sub frames. Thus, the data content of the code book 200 can be determined with considering the influence of timely forward and backward linear interpolations within the predetermined range with respect to a specific one of the sub frames.

On the other hand, in case of coding the linear predictive parameters by the apparatus for coding the linear predictive parameters shown in FIG. 1, the same processes shown in FIG. 3 are performed, so as to code the linear predictive parameters with considering the influence of the linear interpolation.

The above described code book designing method for the linear predictive parameters of the present embodiment can be stored as a computer software program in the record medium 110 such as a CD-ROM, a DVD-ROM, a floppy disc or the like (in FIG. 2B) which is readable by the computer system 100. Then, by installing and executing this program in the computer system 100, the method of and the apparatus for designing the code book 200 of the present embodiment can be realized.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-40509 filed on Feb. 23, 1998 including the specification, claims, drawings and summary is incorporated herein by reference in its entirety.

What is claimed is:

1. A method of designing a code book which is a set of code vectors to be selected when linear predictive parameters are vector-quantized as for an input audio which is divided into frames, each of which is further divided into sub frames, the method comprising the processes of:

calculating the linear predictive parameters of the input audio for the sub frames respectively;

calculating a plurality of quantization candidates which are candidates for the code vectors with respect to the linear predictive parameters of the input audio as for the sub frames positioned at a predetermined interval set in advance;

calculating interpolation values for the linear predictive parameters on the basis of the calculated quantization candidates as for the sub frames other than the sub frames positioned at the predetermined interval; and determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

2. A method according to claim 1, wherein the process of determining the code vectors of the code book comprises the processes of:

calculating distortions of the calculated quantization candidates and the calculated interpolation values with respect to the calculated linear predictive parameters for the sub frames respectively; and determining the code vectors so as to minimize an average of the calculated distortions.

3. An apparatus for designing a code book which is a set of code vectors to be selected when linear predictive parameters are vector-quantized as for an input audio which is divided into frames, each of which is further divided into sub frames, the apparatus comprising:

a calculating device for calculating the linear predictive parameters of the input audio for the sub frames respectively;

a quantizing device for calculating a plurality of quantization candidates which are candidates for the code vectors with respect to the linear predictive parameters of the input audio as for the sub frames positioned at a predetermined interval set in advance;

an interpolating device for calculating interpolation values for the linear predictive parameters on the basis of the calculated quantization candidates as for the sub frames other than the sub frames positioned at the predetermined interval; and a determining device for determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

4. An apparatus according to claim 3, wherein the determining device comprises:

a device for calculating distortions of the calculated quantization candidates and the calculated interpolation values with respect to the calculated linear predictive parameters for the sub frames respectively; and a device for determining the code vectors so as to minimize an average of the calculated distortions.

5. A method of coding linear predictive parameters, by use of a code book which is a set of code vectors to be selected when the linear predictive parameters are vector-quantized as for an input audio which is divided into frames, each of which is further divided into sub frames, the method comprising the processes of:

calculating the linear predictive parameters of the input audio for the sub frames respectively;

calculating a plurality of quantization candidates which are candidates for the code vectors with respect to the linear predictive parameters of the input audio as for the sub frames positioned at a predetermined interval set in advance;

calculating interpolation values for the linear predictive parameters on the basis of the calculated quantization candidates as for the sub frames other than the sub frames positioned at the predetermined interval; and selecting the code vectors from among the calculated quantization candidates on the basis of the calculated quantization candidates, the calculated interpolation values and the calculated linear predictive parameters, within a range of continuous sub frames in a predetermined number set in advance, and outputting the selected code vectors.

6. A method according to claim 5, further comprising the process of updating the code vectors of the code book by the selected code vectors.

7. A method according to claim 5, wherein the selecting process comprises:

a process of calculating distortions of the calculated quantization candidates and the calculated interpolation values with respect to the calculated linear predictive parameters for the sub frames respectively; and a process of selecting the code vectors so as to minimize an average of the calculated distortions.

8. An apparatus for coding linear predictive parameters, by use of a code book which is a set of code vectors to be selected when the linear predictive parameters are vector-quantized as for an input audio which is divided into frames, each of which is further divided into sub frames, the apparatus comprising:

a calculating device for calculating the linear predictive parameters of the input audio for the sub frames respectively;

a quantizing device for calculating a plurality of quantization candidates which are candidates for the code vectors with respect to the linear predictive parameters of the input audio as for the sub frames positioned at a predetermined interval set in advance;

an interpolating device for calculating interpolation values for the linear predictive parameters on the basis of the calculated quantization candidates as for the sub frames other than the sub frames positioned at the predetermined interval; and a selecting device for selecting the code vectors from among the calculated quantization candidates on the basis of the calculated quantization candidates, the calculated interpolation values and the calculated linear predictive parameters, within a range of continuous sub frames in a predetermined number set in advance, and outputting the selected code vectors.

9. An apparatus according to claim 8, further comprising an updating device for updating the code vectors of the code book by the selected code vectors.

10. An apparatus according to claim 8, wherein the selecting device comprises:

a device for calculating distortions of the calculated quantization candidates and the calculated interpolation values with respect to the calculated linear predictive parameters for the sub frames respectively; and a device for selecting the code vectors so as to minimize an average of the calculated distortions.

11. A program storage device readable by a computer for designing a code book, tangibly embodying a program of instructions executable by the computer to perform method processes for designing the code book which is a set of code vectors to be selected when linear predictive parameters are vector-quantized as for an input audio which is divided into frames, each of which is further divided into sub frames, the method processes comprise:

calculating the linear predictive parameters of the input audio for the sub frames respectively;

calculating a plurality of quantization candidates which are candidates for the code vectors with respect to the linear predictive parameters of the input audio as for the sub frames positioned at a predetermined interval set in advance;

calculating interpolation values for the linear predictive parameters on the basis of the calculated quantization candidates as for the sub frames other than the sub frames positioned at the predetermined interval; and determining the code vectors of the code book by selecting the code vectors from among the calculated quantization candidates on the basis of the calculated quantization candidates, the calculated interpolation values and the calculated linear predictive parameters, within a range of continuous sub frames in a predetermined number set in advance.

12. A program storage device according to claim 11, wherein the determining process comprises:

calculating distortions of the calculated quantization candidates and the calculated interpolation values with respect to the calculated linear predictive parameters for the sub frames respectively; and determining the code vectors so as to minimize an average of the calculated distortions.

* * * * *